US005930849A

United States Patent [19]

Marbach

[11] Patent Number: 5,930,849

[45] Date of Patent: Aug. 3, 1999

[54] OPEN POOL FORMING A RESERVOIR FOR LIQUID ESPECIALLY SWIMMING POOL, OF THE OUT-OF-GROUND TYPE

[75] Inventor: Gérard Marbach, Cernay, France

[73] Assignee: Sevylor International, France

[21] Appl. No.: 09/014,156

[22] Filed: Jan. 27, 1998

[51] Int. Cl.[6] ..... E04H 4/00

[52] U.S. Cl. ..... 4/506; 4/488; 4/513

[58] Field of Search ..... 4/488, 506, 513, 4/585, 588, 599, 600; 52/169.1, 169.7

[56] References Cited

U.S. PATENT DOCUMENTS

| | | | |
|---|---|---|---|
| 2,443,440 | 6/1948 | Alvarez | 4/506 |
| 2,714,726 | 8/1955 | Hasselquist . | |
| 2,719,982 | 10/1955 | Hasselquist . | |
| 2,854,049 | 9/1958 | Wyllie | 4/506 |
| 3,001,207 | 9/1961 | Nail | 4/506 |
| 3,660,853 | 5/1972 | Ducrocq et al. | 4/506 |

FOREIGN PATENT DOCUMENTS

| | | |
|---|---|---|
| 0768441 | 4/1997 | European Pat. Off. . |
| 1454105 | 12/1966 | France . |
| 1221425 | 7/1966 | Germany . |

*Primary Examiner*—Charles R. Eloshway
*Attorney, Agent, or Firm*—Dean W. Russell; Kilpatrick Stockton LLP

[57] ABSTRACT

Open pool forming a reservoir for liquid, especially swimming pool, of the out-of-ground type with a flexible wall (2) and an inflatable tubular chamber (3) constituting a floating ring which defines the opening of the pool, characterized in that, in the service position of the pool (1), the upper peripheral region (5) of the flexible wall (2) adjoining the tubular chamber (3) is inclined, relative to the remaining underlying part of the wall, towards the inside of the pool, by virtue of which the upper peripheral region (5) forms a frustoconical reentrant rim underlying the tubular chamber (3) and capable of holding the tubular chamber (3) up when the latter is subjected to a downwards force.

8 Claims, 3 Drawing Sheets

OPEN POOL FORMING A RESERVOIR FOR LIQUID ESPECIALLY SWIMMING POOL, OF THE OUT-OF-GROUND TYPE

The invention relates to improvements made to open pools that form reservoirs for liquid, especially swimming pools, of the so-called "out-of-ground" type (that is to say of the type placed on the ground), having a flexible wall and an inflatable tubular chamber constituting an inflatable ring which defines the opening of the said pool.

Such pools are currently marketed as garden swimming pools and are enjoying a great deal of success because they cost far less than out-of-ground pools of other types, because they occupy a small volume in the deflated/folded up state, and because they are very easy to use (open the fabric out flat, inflate the ring-shaped tubular chamber, fill with water which progressively causes the floating ring to rise and progressively tensions the flexible wall—made, for example, of PVC—under the floating ring.

However, this type of pool has the following drawback. When the floating ring is locally pushed down (for example by a person leaning on it) under the level of the water, water pours out over this pushed-down part which forms a spillway: the weight of the overspilling water running over this pushed-down part of the tubular chamber, and the dynamic effect of the pouring-out water exerted on the top of the pushed-down part of the tubular chamber, cause a downwards resultant force which is applied to the tubular chamber and exceeds the upthrust exerted upwards on the immersed part of the tubular chamber. The result of this is that the tubular chamber cannot resume its initial shape and remains in the form of a spillway over which water continues to pour.

The object of the invention is essentially to propose an improved architecture of pool, particularly swimming pool, of the type in question so as to eliminate the aforementioned drawback, without this resulting in an excessive increase in the cost of manufacture and so that in other respects the improved pool retains the same advantages as the pools of the prior art.

To this end, a pool, especially a swimming pool, as mentioned in the preamble and which is designed in accordance with the invention, is characterized in that, in the service position of the said pool, the upper peripheral region of the flexible wall adjoining the aforementioned tubular chamber is inclined, relative to the remaining underlying part of the wall, towards the inside of the pool.

As a preference, the said upper peripheral region is inclined by an angle smaller than about 70° with respect to the horizontal. Advantageously, the inclination of the upper peripheral region with respect to the horizontal is between zero and about 30°, and is preferably of the order of 10 to 30°.

Thanks to this arrangement, the aforementioned upper peripheral region of the wall forms a re-entrant rim of more or less frustoconical shape underlying the inflatable tubular chamber. Thus, the upthrust is exerted positively not only on the tubular chamber, on that part which is in contact with the liquid, but also under the said re-entrant part of the wall. If the tubular chamber is locally deformed downwards, it comes to rest on the underlying re-entrant part which is still subjected to upthrust under the same conditions and with the same strength. This being the case, the weight of the water spilling out and locally running over the deformed tubular chamber and the dynamic effect of the pouring-out water which acts on the tubular chamber together generate a resultant force which is still smaller than the upthrust, which is stronger here. The tubular chamber therefore automatically reverts to its initial shape as soon as the deforming force is no longer applied to it.

Of the numerous technical solutions that can be used to form the desired re-entrant rim at the upper part of the flexible wall, it is possible to envisage for the upper peripheral region to consist of a flexible strip cut into an arc of a circle and secured end to end to the periphery of the rest of the flexible wall.

However, another solution which is preferred on account of the ease with which it can be carried out when manufacturing the pool, consists in the upper peripheral region being determined by V-shaped notches made, at intervals from one another, around the periphery of the upper edge of the flexible wall and closed back on themselves edge to edge.

The invention will be better understood from reading the detailed description which follows of a number of embodiments which are given merely by way of non-limiting examples. In this description, reference is made to the appended drawings in which.

Figure 1:
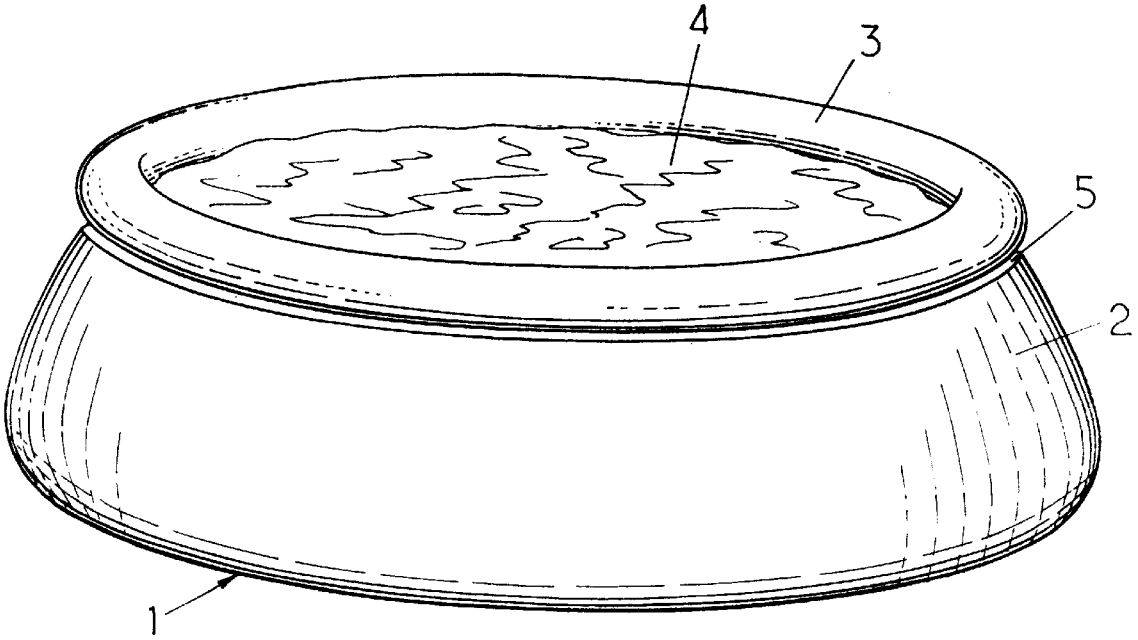
FIG. 1 is a very diagrammatic view, in cross-section, of an open pool designed in accordance with the invention.

Depicted in perspective in FIG. 1 is an open pool 1 full of liquid 4 and forming a reservoir for liquid; in this case it is a swimming pool, even though this is not the only possible application of the invention.

The pool 1 is of the out-of-ground type, that is to say of the type placed on the ground and lying on top of the ground. The pool 1 is defined by an impervious flexible wall 2, for example a film of PVC or a coated fabric. An inflatable tubular chamber 3 constitutes a floating ring which surrounds the opening of the pool.

To use it, the pool is unfolded and laid out flat on the ground; the tubular chamber 3 is inflated, for example with air, and adopts its toric shape. Then a liquid (for example water) is poured into the space surrounded by the inflated tubular chamber; as the liquid level rises, the tubular chamber, which floats, is raised, bringing the flexible wall with it.

In equilibrium, the bottom of the pool is pressed closely against the ground by the weight of the liquid on top of it; the flexible wall 2 is subjected to the hydrostatic thrust, directed radially, of the liquid mass and to the upwards tensile force exerted by the floating tubular chamber; and the floating tubular chamber is subjected to the upthrust, directed upwards, and to the retaining force, directed downwards, exerted by the flexible wall it holds up.

Figure 2:
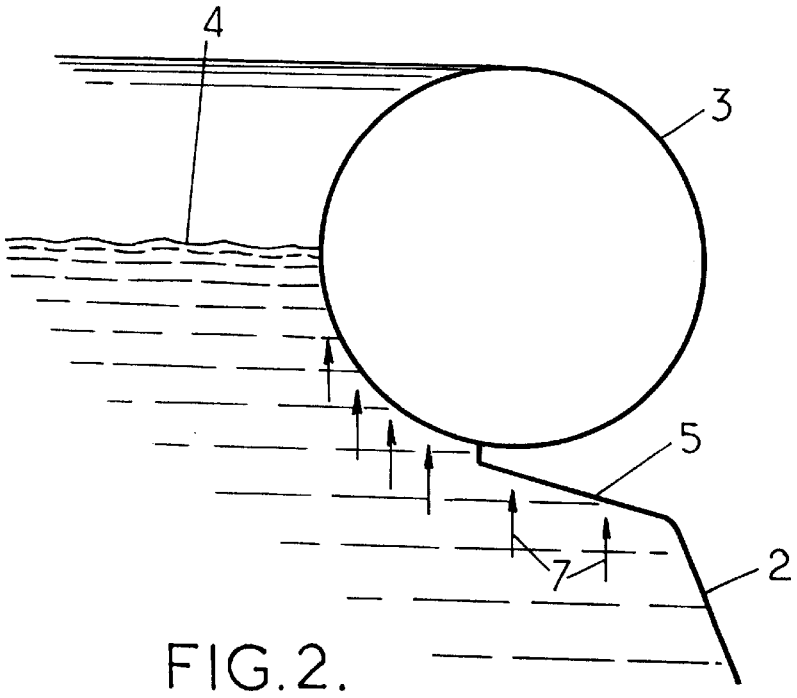
FIG. 2 is a view on a larger scale of part of the pool of FIG. 1, allowing a better understanding of the invention, the inflatable tubular chamber being shown in the normal non-deformed position.

In accordance with the invention, the upper peripheral region 5 of the flexible wall 2, immediately adjoining the tubular chamber 3, is steeply inclined with respect to the underlying part of the wall 2 towards the inside of the pool. This arrangement is particularly better seen in FIG. 2 which shows a cross section, on an enlarged scale, of the tubular chamber 3 and of the adjacent region of the wall 2 of the pool of FIG. 2. The inclination of the said peripheral region 5 is less than about 70° with respect to the horizontal, advantageously being between 0 and about 30°, and preferably being of the order of 10 to 30°.

Thanks to this design, not only is the immersed portion of the tubular chamber 3 subjected to upthrust, but the inclined peripheral region 5 is too (arrow 7). his then increases the area subjected to upthrust.

When the edge of the pool is subjected locally to a downwards force (for example a person leaning on the tubular chamber surrounding the pool), in a pool of traditional design, that part of the wall adjoining the tubular chamber 3 creases without playing a functional part: the weight of the water spilling over the tubular chamber, combined with the dynamic force of the pouring-out water generate on the tubular chamber a downwards resultant force which exceeds the upthrust exerted on the immersed portion of the tubular chamber: when the initial deforming force is no longer applied to the tubular chamber, the latter therefore cannot revert to its initial shape and water continues to pour out.

Figure 3:
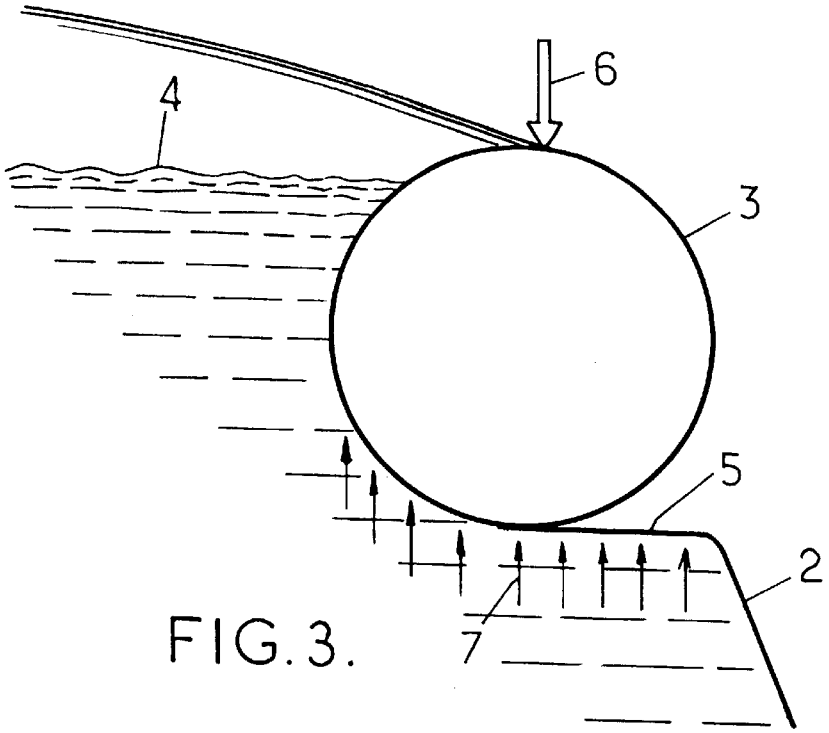
FIG. 3 is a view similar to that of FIG. 2 illustrating the design in accordance with the invention when the tubular chamber is subjected to a downwards force.

By contrast, in a pool designed in accordance with the invention, the increase in area subjected to upthrust means that the increased upwards force exceeds the aforementioned resultant force (the weight of the overspilling water and the dynamic force of the pouring-out water). As soon as the initial deforming force (arrow 6 in FIG. 3) is no longer being applied to the tubular chamber, the upthrust (arrows 7) returns the tubular chamber to its initial position, and the pouring-out of water is halted.

In practice, bearing in mind the forces exerted on the wall 2, a pool of the type in question is, in order to be stable, of approximately circular shape, and the region 5 then has an overall shape which is approximately frustoconical with symmetry of revolution.

There are a number of technical solutions that may be envisaged for giving the flexible wall 2 the required shape at the periphery near the tubular chamber 3.

Figure 4:
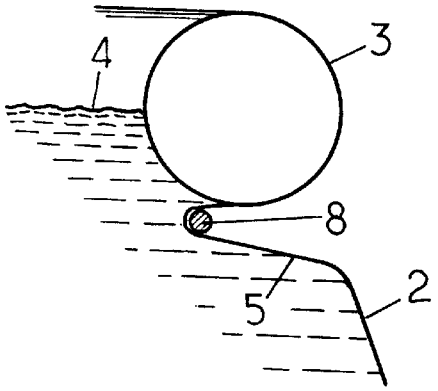
FIG. 4 illustrates, very diagrammatically and in part view, a first practical embodiment of the invention.

It is possible, as illustrated very diagrammatically in FIG. 4, to border the upper region of the wall 2 immediately adjacent to the tubular chamber 3 with an external annular tie 8 (strap, cord, etc.) which runs around the periphery with a diameter which is appreciably smaller than the diameter where the wall meets the tubular chamber.

Figure 5:
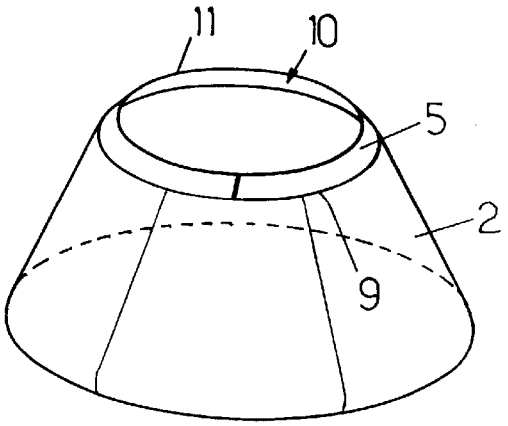
FIG. 5 illustrates, very diagrammatically and in part view, a second practical embodiment of the invention.

Another solution may consist, as illustrated in FIG. 5, in attaching, for example by welding, to the upper edge 9 of the wall 2, a flexible strip 10 of open annular shape (the shape of an arc of a circle) which, once closed on itself and secured to the flexible wall 2, adopts a frustoconical shape and thus constitutes the aforementioned region 5. The tubular chamber 3 is then secured to the free edge 11 of this strip (in FIG. 5, the tubular chamber 3 has not been depicted to make the figure easier to understand).

Figure 6A:
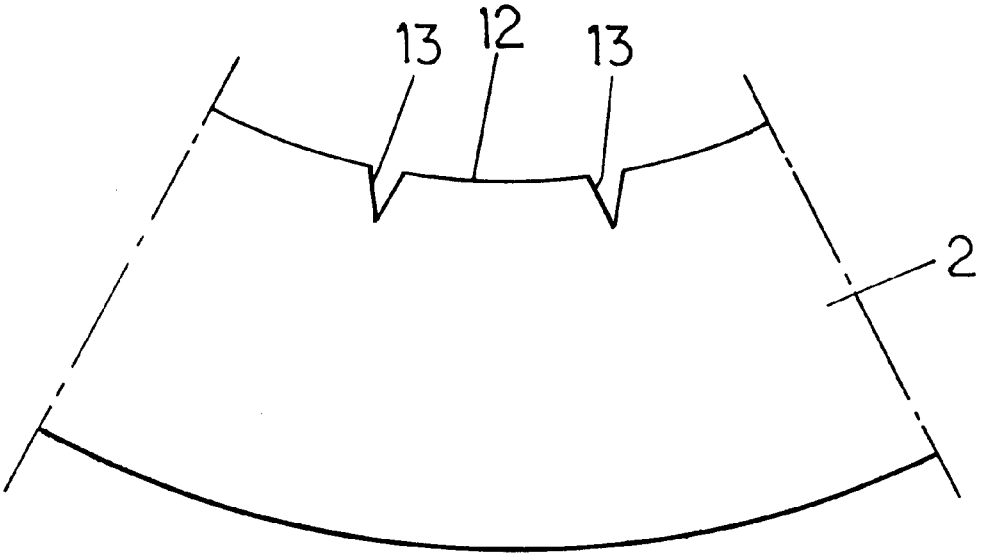
FIGS. 6A and 6B are two views which illustrate, very diagrammatically and in part view, two stages in the preparation of a part of a pool in a third and preferred embodiment of the invention.
Figure 6B:
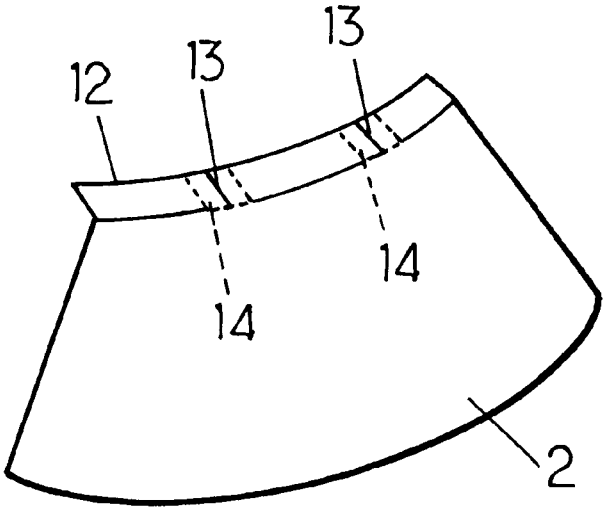

Another solution may consist, as illustrated in FIGS. 6A and 6B, in cutting, in the upper edge 12 of the flexible wall 2, V-shape notches 13 which are spaced apart and the edges of which are then brought together and welded, for example with the addition of a reinforcing piece 14. This design leads to a reduction in diameter of the region 5 adjacent to the edge 12 and therefore to the formation of a region 5 of frustoconical shape inclined towards the inside with respect to the remaining part of the wall 2. This solution is very easy to implement in practice because it makes it possible to work with pieces of flexible material which are flat and for this reason it is currently preferred: the flexible wall 2 of the pool consists, in practice, of a series of panels of curved trapezoidal shapes cut out flat, then joined by their bases to a circular flat bottom. The cutting of the notches and the bringing together of their edges can therefore be done in the flat state on the initial panels.

As goes without saying and as is already obvious from the foregoing, the invention is not in any way restricted to those of its applications and embodiments which have been more specifically envisaged; on the contrary it encompasses all alternative forms thereof.

I claim:

1. A swimming pool defining an interior region for receiving liquid in use and comprising:

a. a tubular float;

b. a flexible wall connected to the tubular float and defining:

i. a bottom region;

ii. a side region adjacent the bottom region, at least a portion of which side region, in use, is inclined toward the interior of the swimming pool at a first angle relative to the bottom region; and iii. an upper peripheral region interposed between the side region and the tubular float and which, in use, is inclined toward the interior of the swimming pool in the same direction as the first angle at a second angle relative to the bottom region, the second angle being smaller than the first angle so that, in use, the upper peripheral region forms a rim directly underlying the tubular float.

2. A swimming pool according to claim 1 in which the tubular float comprises an inflatable chamber.

3. A swimming pool according to claim 2 in which the rim is generally frustoconical and the second angle is less than about 70°.

4. A swimming pool according to claim 3 in which the second angle is between 0 and about 30°.

5. A swimming pool according to claim 4 in which the second angle is between 10 and about 30°.

6. A swimming pool according to claim 1 in which the upper peripheral region comprises a flexible strip cut into an arc of a circle and secured end to end and to the side region of the flexible wall.

7. A swimming pool according to claim 1 in which the upper peripheral region comprises a plurality of spaced V-shaped notches closed on themselves edge to edge.

8. A swimming pool according to claim 1 of generally circular shape and in which the rim underlying the tubular float has symmetry of revolution.

* * * * *